US005441276A

United States Patent [19]

Lim

[11] Patent Number: 5,441,276

[45] Date of Patent: Aug. 15, 1995

[54] DIMPLE PATTERN AND THE PLACEMENT STRUCTURE ON THE SPHERICAL SURFACE OF THE GOLF BALL

[75] Inventor: Dong-keun Lim, Goejeong-dong, Rep. of Korea

[73] Assignee: Dong Sung Chemical Ind. Co., Ltd., Pusan, Rep. of Korea

[21] Appl. No.: 35,923

[22] Filed: Mar. 23, 1993

[30] Foreign Application Priority Data

Feb. 9, 1993 [KR] Rep. of Korea ..... 1993-1771

[51] Int. Cl.[6] ..... A63B 37/12

[52] U.S. Cl. ..... 273/232

[58] Field of Search ..... 273/232, 62

[56] References Cited

U.S. PATENT DOCUMENTS 4,765,626 8/1988 Gobush ..... 273/232

4,974,853 12/1990 Morell ..... 273/232

*Primary Examiner*—George J. Marlo

*Attorney, Agent, or Firm*—Nikaido, Marmelstein Murray & Oram

[57] ABSTRACT

A golf ball having three orthogonal equators and having a dimple pattern composed of six spherical octagons disposed about the intersections of the equators, and eight spherical nonagons making up the rest of the surface of the golf ball.

7 Claims, 5 Drawing Sheets

DIMPLE PATTERN AND THE PLACEMENT STRUCTURE ON THE SPHERICAL SURFACE OF THE GOLF BALL

This invention is directed to golf balls. It more particularly refers to golf balls having different sized dimples which are arranged in a novel pattern.

BACKGROUND OF THE INVENTION AND DESCRIPTION OF THE PERTINENT PRIOR ART

As a golf ball flies, from having been hit with a golf club, and discounting any spin which may have been imparted to the ball by the angular impact direction of the golf club on the golf ball, its forward progress through the air is impeded by eddy currents and the consequent vacuum which is created rearward of the flying ball. To the extent that the air passing around the surface of the flying golf ball is broken up from laminar flow, the eddy currents, and thus this vacuum, is reduced. Thus, golf balls have dimples on their surface to break up the otherwise laminar flow of air over the surface of the golf ball. It is known that increasing the number of dimples increases the distance that a golf ball will fly when hit with the same power. The speed of the air around a flying dimpled golf ball is lower than the air speed would have been had the golf ball had a smooth surface with no dimples. This causes the eddy currents rearward of the ball to be in a narrower area and this reduces the drag on the flying golf ball.

To date, the effort has been to place as many dimples on the surface of the golf ball as possible in a generally symmetrical pattern. To accomplish this, dimples of different sizes have been placed on the surface of the golf ball. Because the dimple patterns are made up of different sized dimples, the performance of the golf balls has been non-uniform because the spin imparted to the golf balls on impact by the golf club has a different effect depending on the particular placement of the different sized dimples. The frictional resistance and the amount of drag are dependent on the way the ball is rotating and therefore uniformity of performance is not achieved.

In the prior art, placing the dimples in a symmetrical pattern has been accomplished by dividing up the surface of the golf ball sphere geometrically symmetrically. The dimples were then placed within these symmetrical subdivisions. The so-called "dimple pattern, which is the criteria for dimple placement, was then applied mechanically by a manufacturing procedure. The dimple pattern is not the dimples themselves, but is the pattern at which the dimples will be placed. The most popular and typical example of a dimple pattern is shown in FIGS. 1 and 2.

In FIG. 1*a*, there is shown a side view of a golf ball with the three equators marked thereon. FIG. 1*b* is a polar view of this same golf ball. For convenience, the areas of dimple emplacement in FIG. 1 is referred to as a "spherical triangle pattern". The succession of eight spherical triangles 21 are defined by the intersecting three equators 11, 12 and 13 of the sphere. The poles 31 and 32 are arbitrarily two opposite points of intersection of two equators. The dimples within any one of the spherical triangles 21 are formed in rows which are parallel to the sides of the triangles 21.

Since the rows of dimples in such a conventional construction are parallel to the sides of the triangles, these rows of dimples form a fixed sinusoidal path for the air passing over the golf ball during flight. Such a path does not reduce the adverse effect of the aerodynamic passage of the air. These problems are especially described in U.S. Pat. No. 4,141,559, and British patents 1,402,271 and 1,401,730. U.S. Pat. Nos. 4,848,766 and 4,765,626 disclosed a new dimple pattern as a means of overcoming the detrimental behavior of the conventional, spherical triangular dimple arrangement. According to the U.S. Pat. No. 4,848,766, the conventional spherical triangular pattern is used, but two different sized dimples were formed within this spherical triangle pattern. This dimple pattern disclosed in this reference had a detriment in that the ratio of small to large dimples was fixed. This forced the designer into using a fixed number of dimples of a particular size, or at least a fixed ratio of small to large dimples as this may yield optimum performance. This disclosure did however remedy the situation of the dimples always being parallel to the equators.

In addition, the disclosure of U.S. Pat. No. 4,765,626 provided for additional small triangles to be formed at the several intersections of the three equators. Dimples were arranged in both the large spherical triangles and in the small triangles. However, this did not sufficiently remedy the situation because the apices of the large and the small triangles were coincident.

OBJECTS AND GENERAL STATEMENT OF THIS INVENTION

This invention aims to provide a geometric pattern on the surface of the golf ball sphere which offers the designer the ability to vary the sizes of the dimples and the configuration of surface of the sphere so that in the dimple pattern the rows of dimples are not necessarily parallel to the equators, or the dimple pattern is not perfectly symmetrical.

The surface of the golf ball sphere according to this invention is laid out in a series of spherical nonahedra and spherical octahedra. There are six spherical octahedra and eight spherical nonahedra. The octahedra are each substantially identical in form and size to each other and are each disposed surrounding the intersections of the three equators of the golf ball, respectively. The octahedra are each made up of composite structure of a square and four, preferably equilateral, triangles each disposed with a side in common with the respective sides of the square. In the preferred embodiment of this invention, the sides of the octahedra are all the same length, because, after the square and the triangles are composited into a single geometric shape, the resultant composite geometric shape is made up of the sides of the equilateral triangles referred to above which are not in common with the square. Rather than having the conventional equilateral octahedron intersecting angles of 135°, the angles between the sides of the octahedra are, respectively, four of 60° (from the equilateral triangles) alternating with four of 210° (made up of the sum of an angle of the square added to two angles of the equilateral triangle).

The sides of the nonahedra are irregular in the sense that they are not all of the same length. They are however regular in the sense that all of the nonahedra have the same configuration and size. Six of the sides of the nonahedra are made up of the sides of the triangles referred to above as forming the composite octahedra. The remaining three sides are the remainder of the equators after subtraction of the octahedra, respectively, therefrom. Actually, the length of these remaining three sides of each nonahedron are one-quarter of an equator, with two triangle heights and two half square heights subtracted therefrom.

The surface of the golf ball is thus divided into spherical octahedra and nonahedra, instead of the more conventional six sided and four sided polygons of the prior art. According to this invention, the surface of the golf ball is divided into 6 spherical squares, 24 spherical triangles, which collectively make up the 6 spherical octagons, and 8 spherical nonagons which are the remainder of the surface of the golf ball. It is into these defined areas that the dimples are arranged in a manner suited to any particularly chosen design.

DETAILED DESCRIPTION OF THIS INVENTION

According to one aspect of this invention, dimples of three distinct sizes are judiciously placed within the spherical nonagons, and spherical octagons and of the above described pattern. In one example of an embodiment of this invention, there are utilized dimples of three different sizes, 0.13, 0.145 and 0.15 inch. The 0.13 inch dimples are formed within the triangular portions and the square portion of the octagons, with some of the smaller dimples intersecting the sides of the triangles. The 0.145 and 0.15 inch dimples are formed in an alternating pattern as rows juxtaposed the sides of the nonahedra. The areas within the nonagons which are circumscribed by these rows of alternating diameter dimples are filled only with dimples of 0.145 inch diameter. In this manner none of the rows of dimples are completely parallel to any equator of the golf ball surface.

Figure 1A:
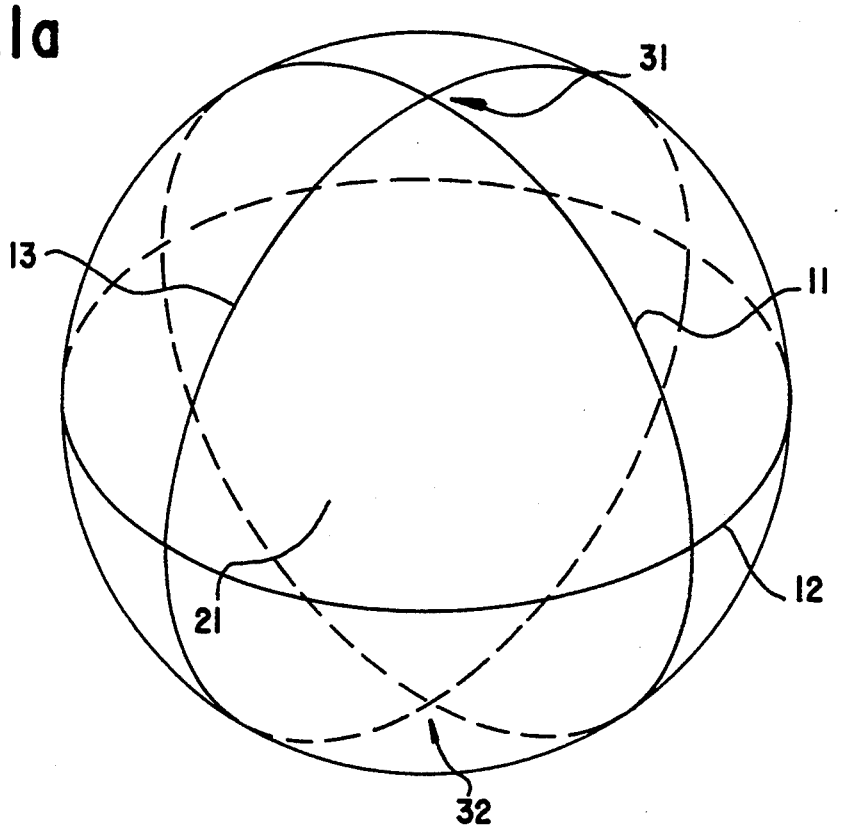
FIG. 1*a* is a side view of a prior art dimple pattern for a golf ball.
Figure 1B:
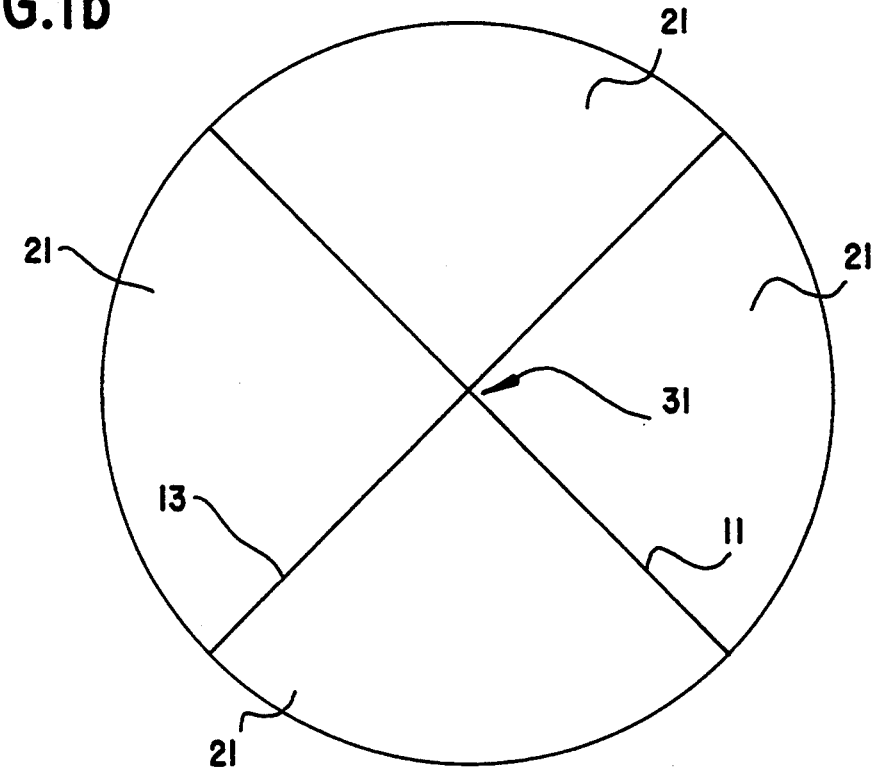
FIG. 1*b* is a polar view of this same golf ball of FIG. 1*a*, that is the prior art.
Figure 2:
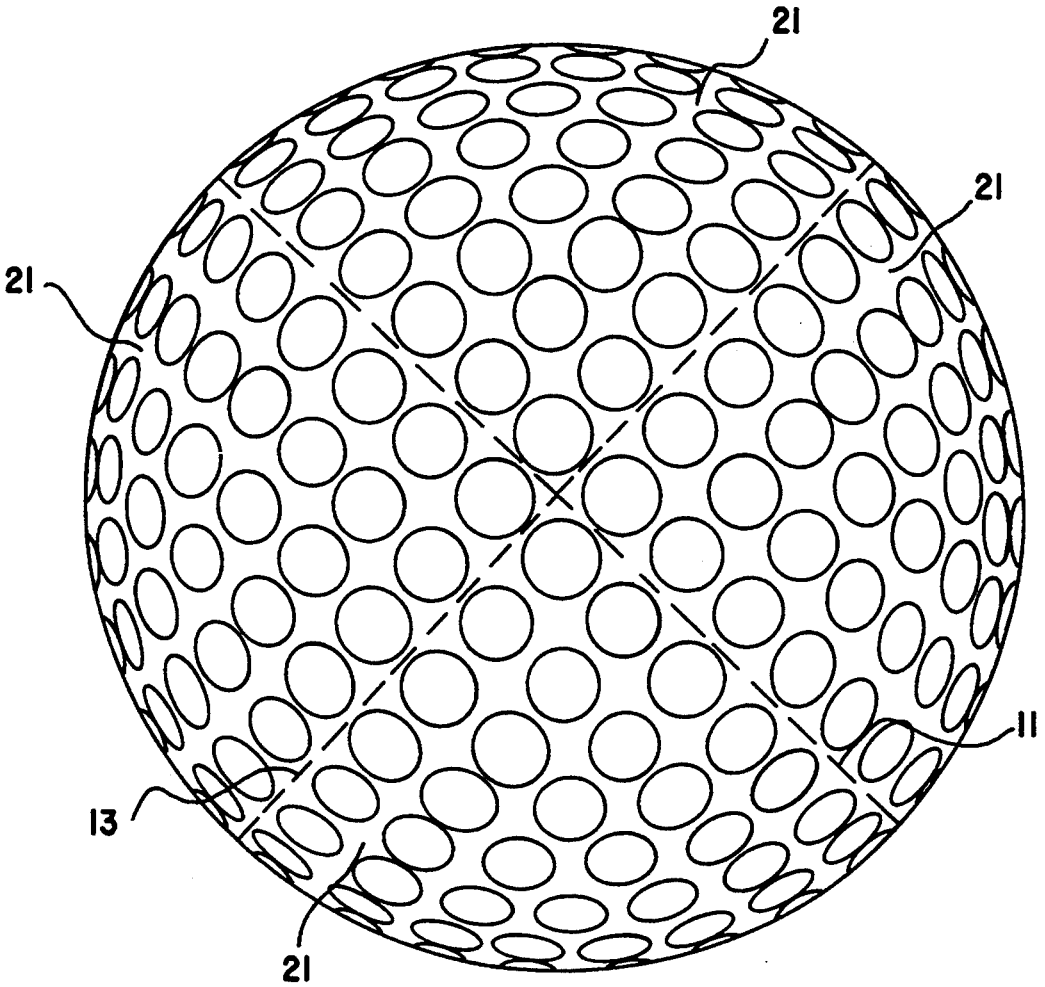
FIG. 2 is a polar view of a prior art spherical triangular disposition of dimples.
Figure 3A:
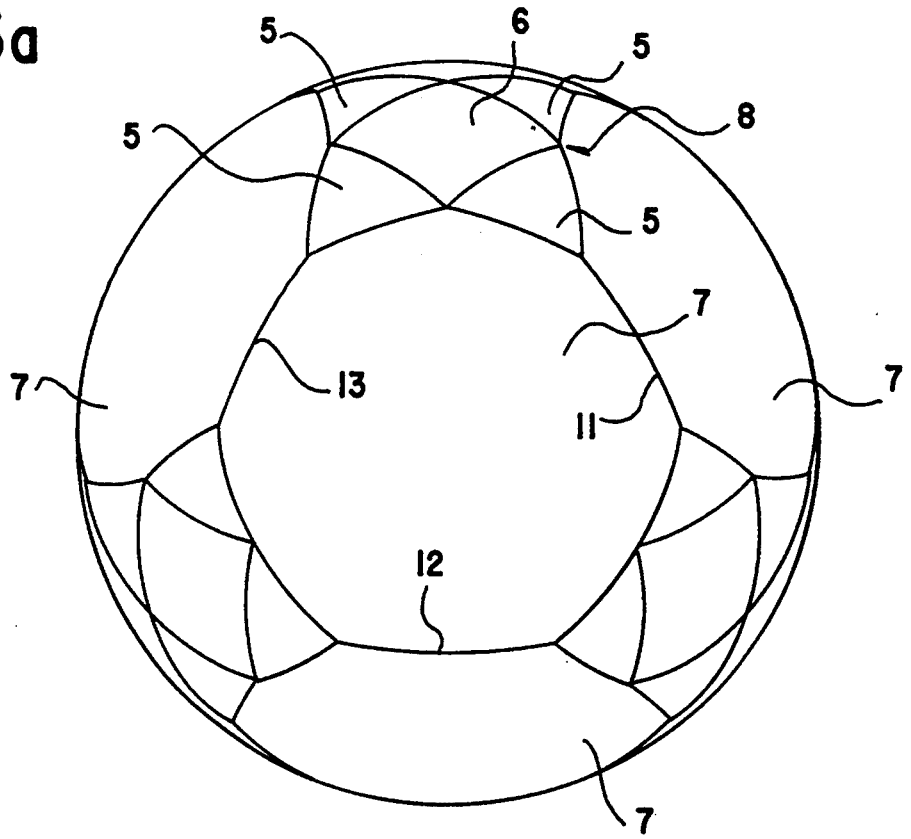
FIG. 3*a* is a side view of a dimple pattern on a golf ball according to this invention.
Figure 3B:
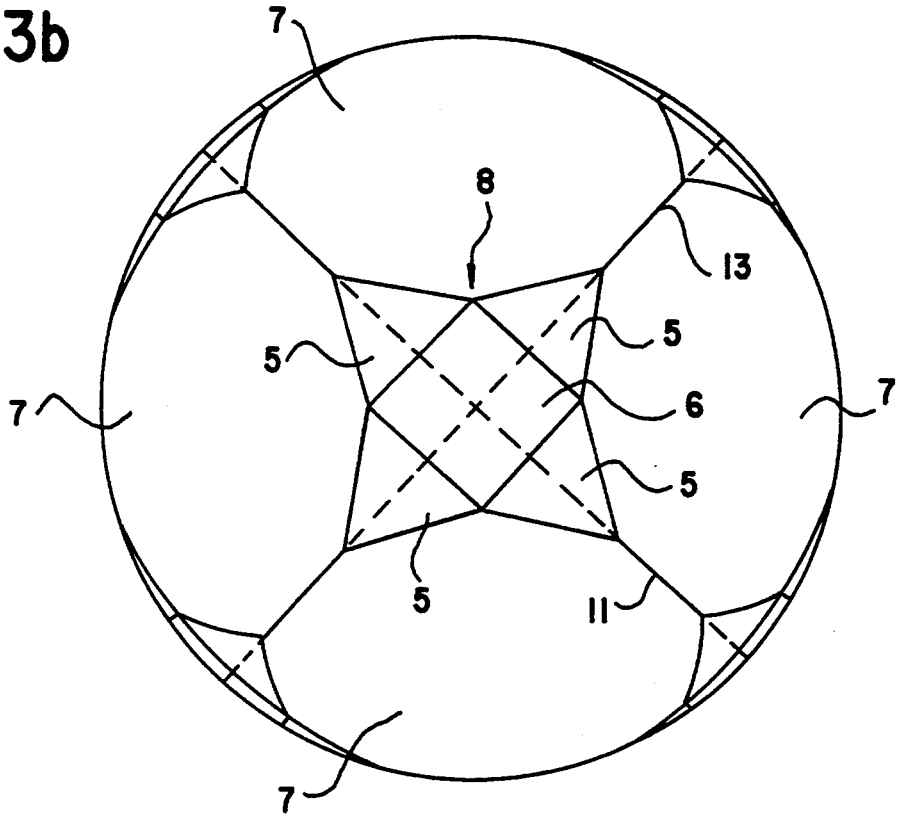
FIG. 3*b* is a polar view of the golf ball of FIG. 3*a;*

According to another aspect of this invention, dimples of six distinct sizes, 0.075, 0.125, 0.145, 0.150, 0.155, and 0.160 can be conveniently fit into the above described geometric arrangement of the surface of the golf ball sphere. Four dimples each of 0.16 inch diameter are disposed in each of the squares; two each of the 0.075 and 0.125 inch diameters are disposed in each triangle with the larger of these being disposed toward the adjacent square, and the two smaller diameter dimples being disposed toward the apex of the triangle opposite to the square; the lines of dimples juxtaposed the sides of the nonagons are all 0.15 inch in diameter; and the spaces defined within the nonagons circumscribed by the rows of 0.15 inch diameter dimples juxtaposed the nonagon sides are filled with dimples of 0.145, 0.15 and 0.155 inch diameter. Again, it will be seen that none of the rows of dimples are completely parallel to any equator of the golf ball surface Reference is now made to the drawing of this specification, and specifically to FIG. 3*a* thereof which shows a side view, with one nonagon centered in the view for ease of understanding, of a dimple pattern according to this invention, as well as to FIG. 3*b*, which shows a polar view of this same golf ball dimple pattern. Three equators, 11, 12 and 13 are shown in orthographic relationship to each other. A spherical square area 6 is disposed equidistant from where these equators cross each other and four spherical equilateral triangles 5 are disposed about each spherical square 6 with one side of each triangle being the same as one side of the square. Each of these six composite figures comprise a spherical octagon, respectively with eight equal sides, each of which is derived from two sides of the four spherical triangles 5. The space that is left on the surface of the sphere after delineation of these octagons is thus divided up into eight nonagons 7 each of which is bounded by nine sets of spherical lines composed of two sides of each of three of the referred to spherical triangles and three half equators. The spherical angles between the sides of the nonagons are each 150°.

Figure 4:
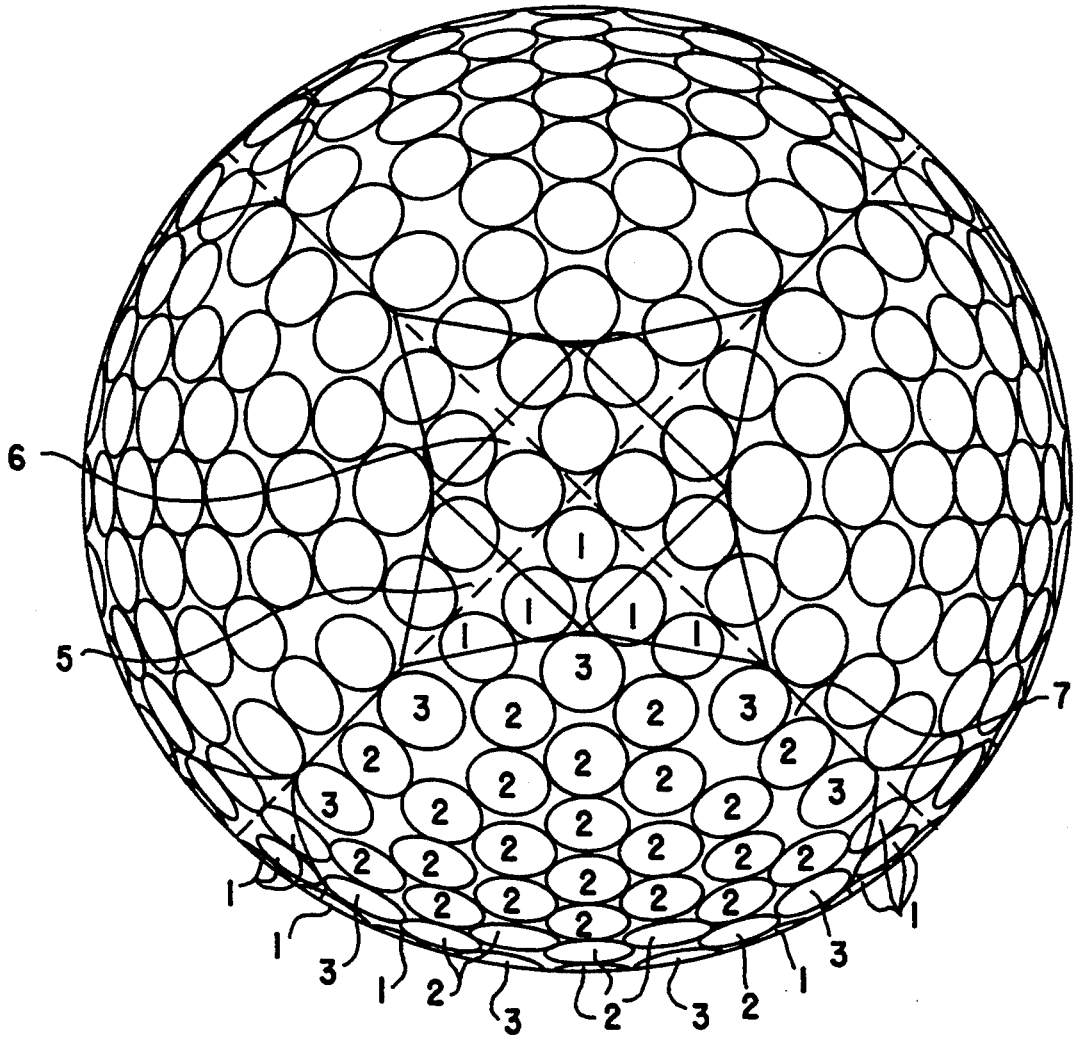
FIG. 4 is a polar view of one dimple placement pattern according to one embodiment of this invention.

Reference is now made to FIG. 4 of the accompanying drawing which is a polar view of one embodiment of the placement of three varieties of dimples in the various areas on the spherical golf ball of this invention. It will be seen that in this example the 0.13 inch dimples 1 are located within each of the squares 6 and intersecting the sides of the triangles 5. The 0.145 inch dimples 2 alternate with the 0.15 inch dimples 3 to form a line of dimples within the nonagons 7 juxtaposed the sides of these nonagons so as to form a circumscribed area within the nonagons. It is to be noted that the centers of these dimples 2 and 3 do not align parallel to the equator which is proximate thereto. This circumscribed space is filled with dimples 2 of 0.145 inch diameter. In this embodiment of this invention, there are used 120 of the 0.13 inch dimples, 224 of the 0.145 inch diameter dimples, and 73 of the 0.15 inch diameter dimples.

Figure 5:
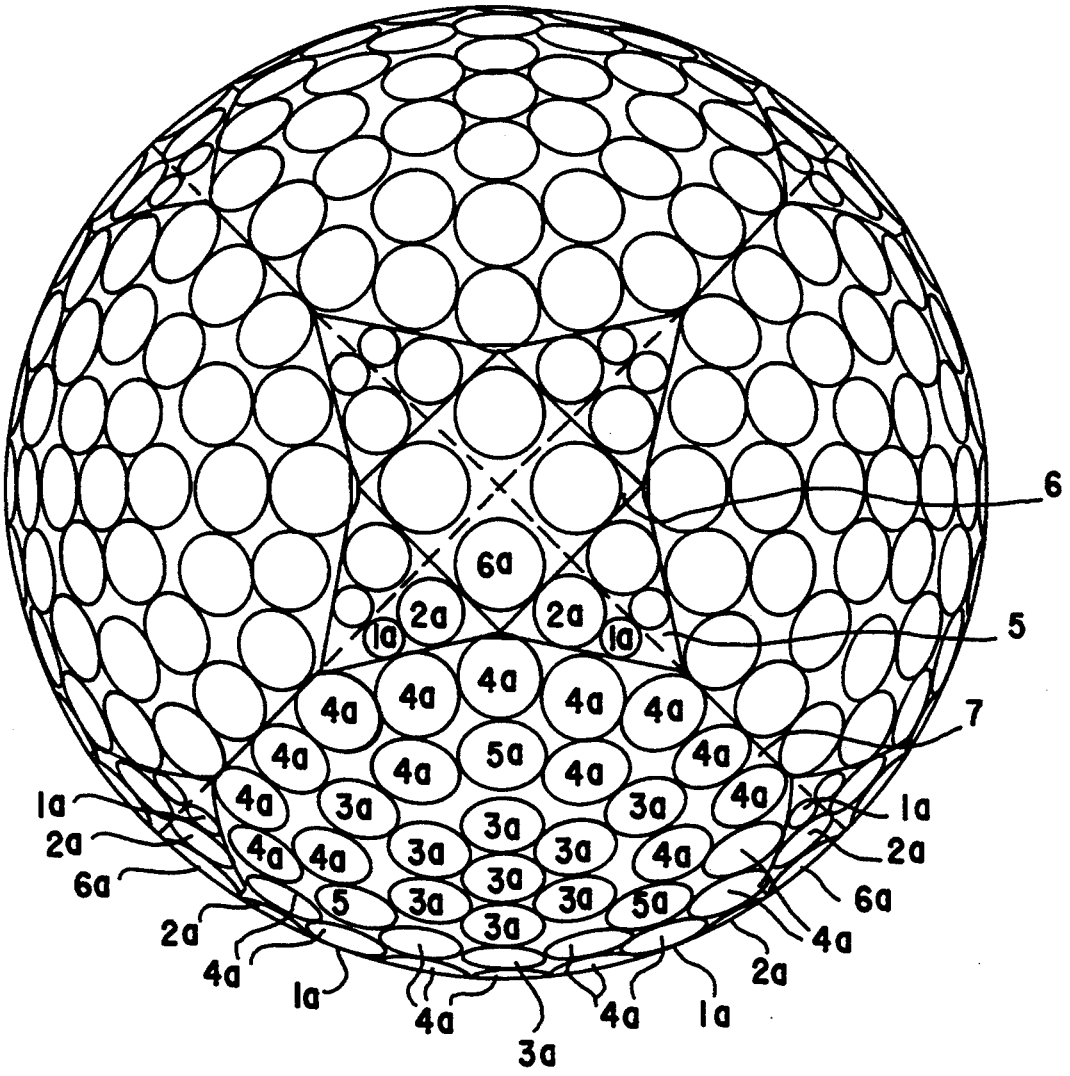
FIG. 5 is a polar view of another dimple placement pattern according to another embodiment of this invention.

Reference is now made to FIG. 5 of the accompanying drawing which is a polar view of another embodiment of the invention and shows the placement of six varieties of dimples in the various octagon and nonagon areas on the spherical golf ball of this invention. It will be seen that four of the 0.16 inch dimples 6*a* are located within each of the squares 6; and two of the 0.075 inch dimples 1*a*, and two of the 0.125 inch dimples 2*a* are disposed within each of the triangles 5. The two larger dimples 2*a* are disposed within the triangles 5 adjacent the squares 6, and the two smaller dimples 1*a* are disposed within the triangles 5 away from the square 6. The 0.15 inch dimples 4*a* form a line of dimples within the nonagons 7 juxtaposed the sides of these nonagons so as to form a circumscribed area within the nonagons. This space within this circumscribed area is filled with dimples of 0.145 inch diameter 3*a*, 0.150 inch diameter 4*a*, and 0.155 inch diameter 5*a*. Again, it will be noted that the centers of the various dimples do not align to form a line which is parallel to any equator.

The improvements which result from the use of the dimple pattern according to this invention are the result of disposing dimples in a pattern where laminar or sinusoidal air flow is broken up. Additionally using multiply different sized dimples in any given row such that no row of dimples has the same size dimple from one end to the other further assists in reducing eddy currents and therefor drag. This configuration increases flying distances by decreasing the drag, or pressure resistance, caused by the eddy currents which otherwise form rearward of the ball when in flight.

I claim:

1. A golf ball comprising a dimpled surface on which there are defined:

three orthogonal equators;

six spherical squares each centered by an intersection of two of said equators, wherein said two equators are normal to sides of corresponding squares, respectively; and 24 equilateral spherical triangles, one side of each of which being coincident with one side of one of said squares,and an apex of each of said triangles being on one of said equators; wherein each set of four of said triangles and one attendant square forms a spherical octagon;

wherein said surface therefore comprises eight spherical nonagons and six spherical octagons;

wherein each of said nonagons is formed of, respectively, one side of each of six of said equilateral spherical triangles, respectively, and three sides of portions of each of said equators, respectively;

wherein said dimpled surface is made up of a plurality of dimples of at least three different diameters; and wherein no row of dimples is made up solely of dimples of the same diameter and no row of dimples has a line connecting all of the dimple centers which is straight or is parallel to an equator.

2. A golf ball as claimed in claim 1 wherein the sides of said squares are equidistant from said intersections.

3. A golf ball as claimed in claim 1 wherein the angles of intersection of the sides of said octagons are, respectively, alternatingly 60° and 210°.

4. A golf ball as claimed in claim 1 wherein the angles of intersection of the sides of said nonagon are each 150°.

5. A golf ball as claimed in claim 1 comprising dimples of three, respectively increasing diameters, one smallest, one medium, and one largest.

6. A golf ball as claimed in claim 5 wherein said smallest diameter dimples are disposed within said octagons as well as intersecting the sides of said octagon, rows of alternatingly disposed medium and largest size dimples with misaligned centers are disposed within said nonagons juxtaposed the sides thereof, and respective spaces within said nonagons, circumscribed by said rows of misaligned medium and largest sized dimples, contain medium size dimples.

7. A golf ball as claimed in claim 1 comprising dimples of six successively larger diameters wherein the largest diameter dimples occupy said squares, two each of the smallest diameter dimples and next to the smallest diameter dimples occupy said triangles, respectively, with the remaining dimples being disposed within said nonagons.

* * * * *